US005150801A

United States Patent [19]

Held

[11] Patent Number: 5,150,801

[45] Date of Patent: Sep. 29, 1992

[54] DETACHABLE CAP FOR A BOTTLE NECK

[76] Inventor: Wolfgang Held, Holzlutweg 7, A-6972 Hardt, Austria

[21] Appl. No.: 499,398

[22] PCT Filed: Mar. 21, 1989

[86] PCT No.: PCT/EP89/00309

§ 371 Date: Jun. 14, 1990

§ 102(e) Date: Jun. 14, 1990

[87] PCT Pub. No.: WO89/09591

PCT Pub. Date: Oct. 19, 1989

[30] Foreign Application Priority Data

Apr. 8, 1988 [DE] Fed. Rep. of Germany ..... 3811730

[51] Int. Cl.[5] ..... A61J 9/08; A61J 11/04

[52] U.S. Cl. ..... 215/11.6; 215/11.1; 215/306; 220/375

[58] Field of Search ..... 220/375, 23.23; 215/306, 258, 11.1, 11.6, 101

[56] References Cited

U.S. PATENT DOCUMENTS

| | | | |
|---|---|---|---|
| 595,414 | 12/1897 | Roach | 215/11.1 |
| 624,974 | 5/1899 | Provis | 215/101 |
| 779,582 | 1/1905 | Brooke | 215/11.1 |
| 1,425,532 | 8/1922 | Marr | 215/11.6 |
| 2,096,961 | 10/1937 | Condon | 215/11.6 |
| 2,579,194 | 12/1951 | Kronish | 215/11.6 |
| 2,588,991 | 3/1952 | Schellin | 215/11.1 |
| 2,618,499 | 11/1952 | Scharf | 294/28 |
| 2,760,665 | 8/1956 | Zenker | 215/11.1 |
| 2,991,913 | 7/1961 | Goth | 222/420 X |
| 3,323,276 | 6/1967 | Thomas | 215/11.6 X |
| 3,393,817 | 7/1968 | Meierhoefer | 215/11.6 X |
| 3,746,198 | 7/1973 | Howland | 215/11.1 |
| 3,782,578 | 1/1974 | Balin | 215/11.6 X |
| 4,623,068 | 11/1986 | Brown et al. | 215/11.1 |

FOREIGN PATENT DOCUMENTS

| | | | |
|---|---|---|---|
| 514123 | 6/1955 | Canada | 215/11.1 |
| 295677 | 3/1916 | Fed. Rep. of Germany . | |
| 8108586 | 11/1981 | Fed. Rep. of Germany . | |
| 3104861 | 8/1982 | Fed. Rep. of Germany . | |
| 384615 | 4/1908 | France | 215/11.1 |
| 422210 | 3/1911 | France . | |
| 1459338 | 11/1966 | France . | |
| 2291683 | 6/1976 | France . | |
| 692418 | 7/1965 | Italy | 215/306 |
| 8903204 | 4/1989 | PCT Int'l Appl. | 215/11.1 |
| 222798 | 10/1924 | United Kingdom | 215/11.1 |
| 1346592 | 2/1974 | United Kingdom | 215/306 |

*Primary Examiner*—Sue A. Weaver
*Attorney, Agent, or Firm*—Speckman & Pauley

[57] ABSTRACT

A baby bottle having a neck with a mouth, and a nipple with a horizontal flange, supported by an annular cap which is detachably connectable to the neck. The annular cap is a portion of a hollow cylinder having a radially inwardly oriented flange that presses and seals the flange of the nipple against a face end of the mouth. The annular cap is connected with a joint to an approximately fork-shaped retaining body. The retaining body is capable of being detachably snapped onto a circumferential annular groove of an outer wall of the neck. The retaining body has legs that extend over more than 180° of a neck circumference of the neck. A first side of the annular cap which is diametrically opposite from the joint has a detent protrusion facing inward that is detachably connectable to a detent recess of the neck.

11 Claims, 4 Drawing Sheets 54
62
60
64
XIV
XIV 54
62
66
XIII
XIII
61
65
60
64
56

66
62
61
65
60
64
54

68

50
68
52
44
78
X
XI
70

50
78
52
76

DETACHABLE CAP FOR A BOTTLE NECK

BACKGROUND OF THE INVENTION

1. Field of the Invention

The invention relates to a baby bottle having a neck with a mouth and a nipple with a horizontal flange, which is supported by an annular cap detachably connectable to the neck, is placed on the face end of the mouth, and can be sealed off from the mouth of the bottle.

2. Description of Prior Art

In conventional baby bottles of this generic type, the connection between the nipple and the bottle can be made with a threaded annular cap. For refilling the baby bottle, the annular cap must be detached from the body of the bottle and set aside. This involves a disadvantage that the nipple will get dirty or drop on the floor. If several bottles are refilled at the same time, as a is the case in hospitals, then there is the further disadvantage that the various nipples will be reassemble on the wrong bottles.

SUMMARY OF THE INVENTION

Based on the above prior art, it is the object of the invention to improve a baby bottle of the type described above in such a way that, without entailing disproportionate engineering expense, is an undetachable connection between the baby bottle and the nipple even when the bottle is to be refilled.

This object is attained in accordance with the invention with an annular cap pivotally attached to the neck and connectable with it in such a way that it is pivotal out of its active operational position in which the flange of the nipple pressure against the face end of the mouth into one of its passive operational positions. The nipple is disposed laterally of the face end of the mouth or laterally of the neck, leaving the mouth free.

The invention is achieved whenever the annular cap carrying the nipple is connectable to the neck in such a way that first, it can connect the nipple to the baby bottle in the manner typical for the conventional threaded annular caps, and second, it establishes a connection between the baby bottle and the nipple even when the nipple is not connected compressively to the mouth.

Further practical and advantageous features of the invention are defined by the dependent claims.

A particularly advantageous feature of the invention is that the annular cap is carried by a retaining body detachably connectable to the neck and is connected to this retaining body via a joint. It is advantageous if the retaining body is an approximately fork-shaped connecting piece that can be snapped into place onto the neck and has legs that extend over more than 180° of the circumference of the neck. In this embodiment of the invention, the actual connection between the annular cap and the neck of the bottle is established with a retaining body that is detachably connected through a detent connection, to the neck.

In another practical embodiment of the invention provides that the annular cap is a portion of a hollow cylinder having a radially inwardly oriented flange that presses the flange of the nipple against the face end of the mouth. If the side of the annular cap diametrically opposed to the joint, which in particular is a hinge, has an inwardly oriented detent protrusion that is detachably connectable to a detent recess of the neck, then the annular cap is essentially a conventional annular cap but has no internal thread. Instead, it is a hollow-cylindrical portion that can be snapped into place on the end piece of the neck. If the baby bottle is refilled, then the annular cap can be actuated in the vicinity of its detent protrusion, releasing this detent connection, and the annular cap then pivots about the hinge.

In a baby bottle having a cup-shaped cover cap that receives the nipple and is detachably connectable to the neck, such as a sealing cap or guard, it is practical for the cover cap to have at least one protrusion on the inside protruding toward the annular cap. In the active state of the cover cap, this protrusion is compressively connected to the side of the annular cap remote from the face end of the mouth. Good, uniform distribution of pressure is attainable for instance when the protrusion is cylindrical and is aligned with the neck in the active state of the cover cap. Within the scope of this invention, it is particularly practical for the cover cap to comprise a basic body that can be screwed to the neck and a cup-shaped attachment detachably connected to it, in which the nipple is accommodated. The advantage of this embodiment of the invention is that the cover cap first serves as nipple guard means and second prevents unintentional loosening of the annular cap from the neck of the bottle.

Another practical feature of the invention provides that the face end of the attachment, connectable to the basic body has at least one spring, engaging the opening of the basic body from behind, and has a detent tab. An adequate connection is attainable for instance with three springs distributed over the circumference. To improve the detent connection between the springs and the basic body, it is practical for the inside of the opening detachably connectable to the attachment to have an annular groove which is engaged with the detent tabs of the springs.

Another practical embodiment of the invention provides that the end of the baby bottle oriented toward the bottom is detachably connectable to a base having a temperature sensor. In such embodiment, not only is the ability of the bottle to stand on its own increased, but at the same time it is ascertained whether the baby food is at the correct temperature. A temperature film that is glued onto the base can be used as the temperature indicator. Within the scope of this invention it is advantageous if the base comprises a hollow-cylindrical portion, which can be detachably connected to the end of the bottle, and an approximately circular surface for the bottle to stand, the diameter of which is larger than the diameter of the baby bottle.

BRIEF DESCRIPTION OF DRAWINGS

An exemplary embodiment of the invention is schematically shown in the drawing and will be described in further detail wherein.

DESCRIPTION OF PREFERRED EMBODIMENTS

Figure 1:
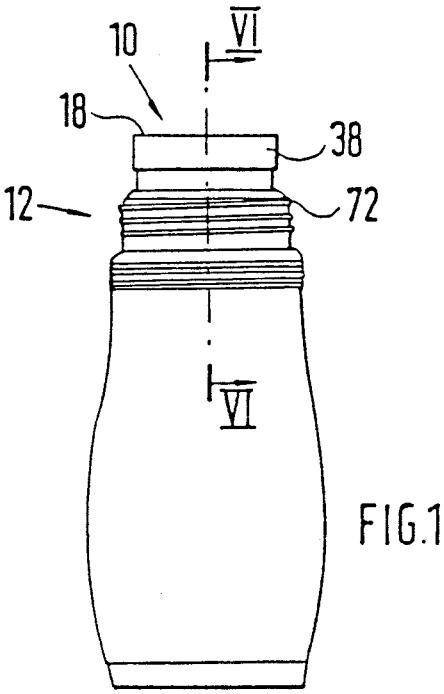
FIG. 1 is a side view of an uncapped baby bottle.
Figure 5:
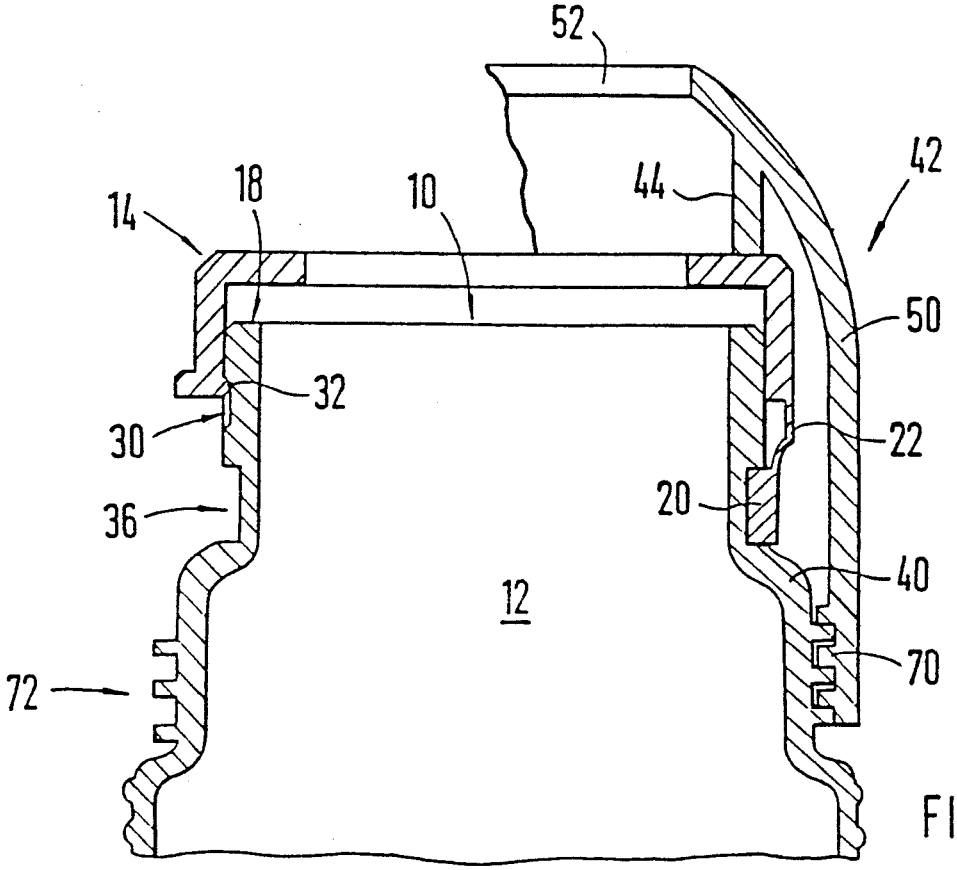
FIG. 5 shows part of the section along the line V—V of FIG. 2.
Figure 6:
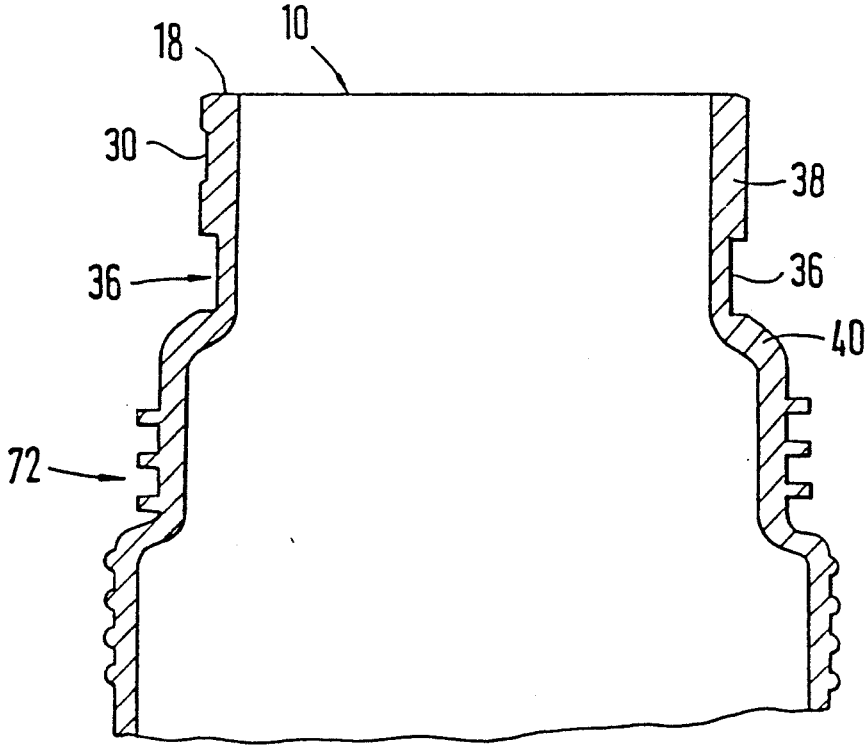
FIG. 6 shows part of the section along the line VI—VI of FIG. 1.

In FIGS. 1, 5 and 6 a baby bottle, or part of a baby bottle, having a neck with a mouth 10 is shown. The mouth 10 can be connected to a nipple, not shown in the drawing, having a horizontal flange supported by an annular cap that can be detachably connected to the neck. The flange is placed on the face end 18 of the mouth 10 and can be sealed off from it.

As FIG. 5 shows, the annular cap 14 is pivotally attached to the neck 12 and can be connected to it in such a way that it is pivotal out of an active operational position in which the flange of the nipple is pressed against the face end 18 of the mouth 10 into one of its passive operational positions. In such passive operational position the nipple is disposed laterally of the face end 18 of the mouth 10 or laterally of the neck 12 and leaves the mouth 10 free.

Figure 7:
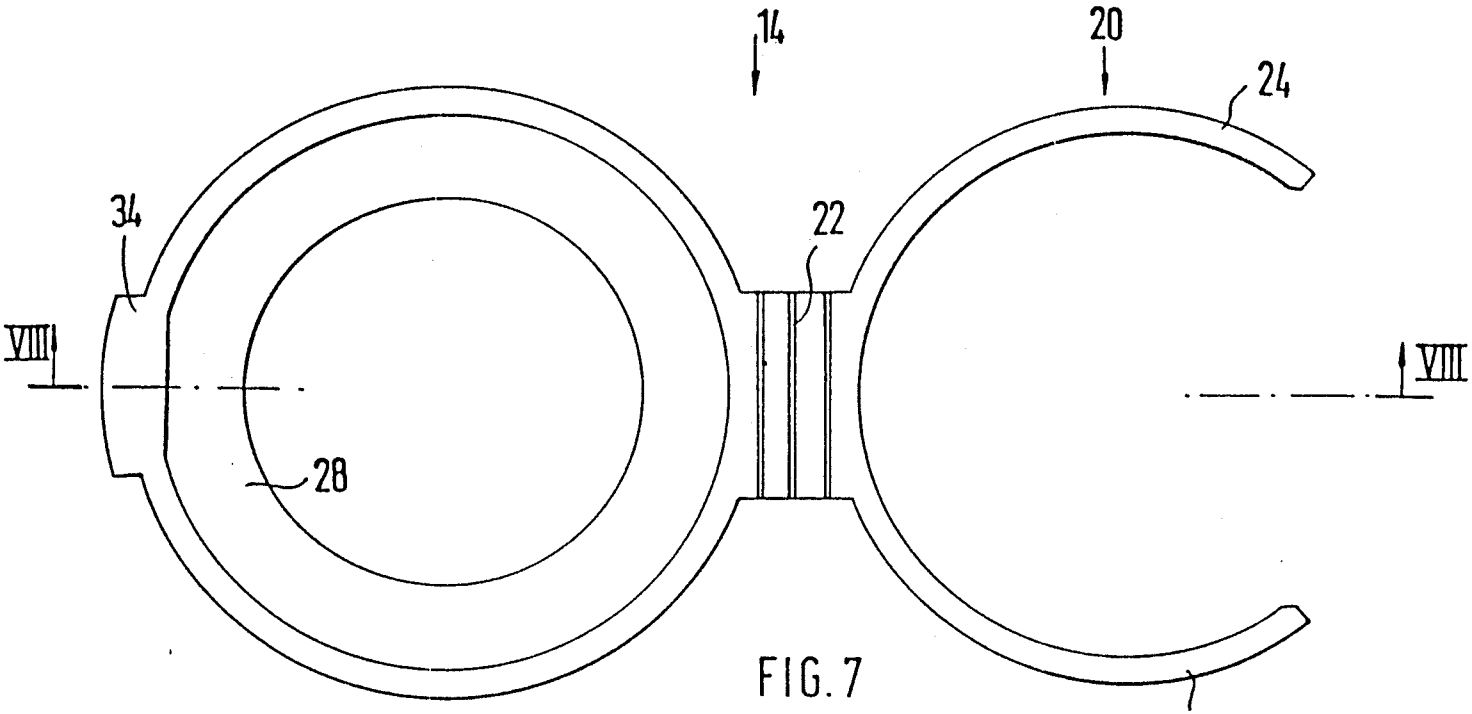
FIG. 7 shows a vertical plan view on an annular cap.
Figure 8:
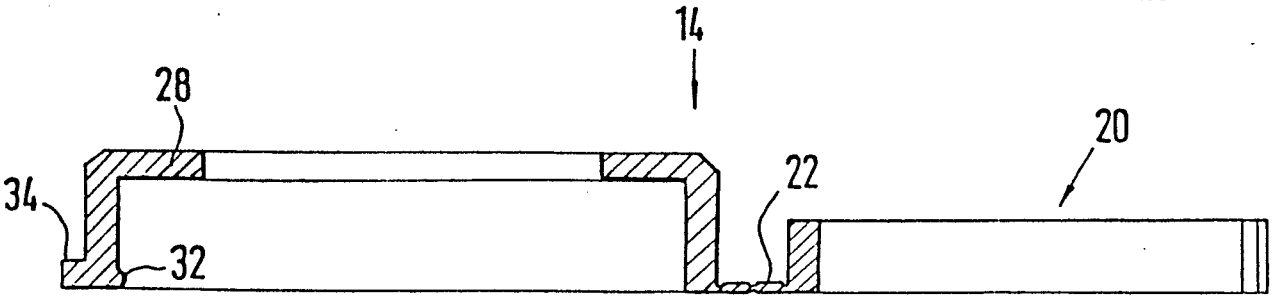
FIG. 8 shows a section taken along the line VIII—VIII of FIG. 7.
Figures 9, 10, 11, 12, 13, 14:
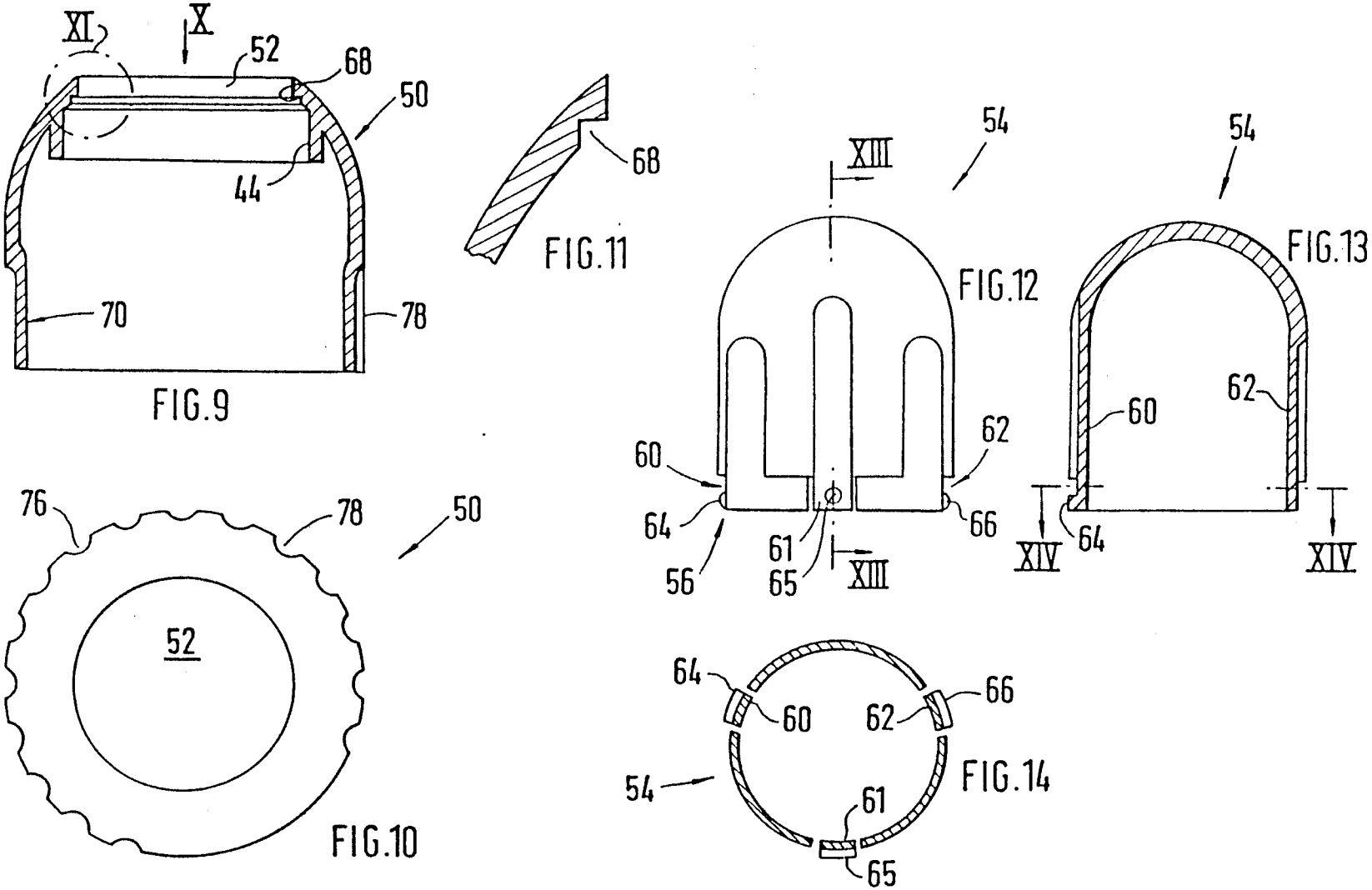
FIG. 9 shows an axial section through a cover cap.
FIG. 10 shows a plan view on the cover cap of FIG. 9 in the direction of the arrow X.
FIG. 11 shows the portion marked XI of the cover cap of FIG. 9, shown on an enlarged scale.
FIG. 12 shows a side view of an attachment.
FIG. 13 shows a section taken along the line XIII—XIII of FIG. 12.
FIG. 14 shows a section along the line XIV-XIV of FIG. 13.

FIGS. 7 and 8 show the annular cap 14 supported by a retaining body 20 detachably connected to the neck 12 and connected to the retaining body via a joint 22. The retaining body 20 is an approximately fork-like connecting piece that can be snapped onto the neck 12 with legs 24 and 26 that extend over more than 180° of the neck circumference. As shown in FIG. 8, the annular cap 14 is a portion of a hollow cylinder having a radially inwardly oriented flange 28, which can press the flange of the nipple against the face end 18 of the mouth 10. The side of the annular cap 14 diametrically opposite from the joint or hinge 22 has a detent protrusion 32 facing inward that is detachably connected to a detent recess 30 of the neck 12. This detent protrusion 32 can be actuated via an actuation protrusion 34.

The outer wall of the neck 12 has an annular groove 36 about the circumference, onto which the retaining body can be snapped. The annular groove 36 is defined from above via a flange 38, while in its lower region it annular groove 36 is defined by an enlargement 40 in the diameter of the neck 12.

Figure 2:
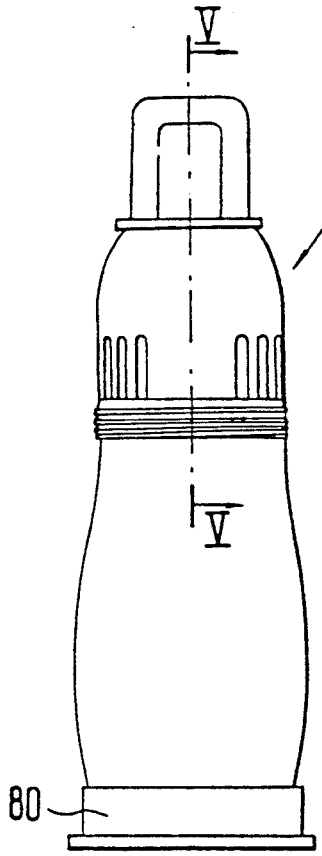
FIG. 2 is a baby bottle as shown in FIG. 1, capped.

FIGS. 2 and 5 particularly show a cup-like cover cap 42, for instance a sealing cap or guard, that receives the nipple and is detachably connectable to the neck. The cover cap 42 has a cylindrical protrusion 44 on the inside, protruding toward the annular cap 14. In the active state of the cover cap 42 as shown in FIG. 5, the protrusion 44 is compressively connected with the side of the annular cap 14 remote from the face end 18 of the mouth 10. The protrusion 44 is in alignment with the end portion of the neck 12.

FIGS. 2 and 9–14 show that the cover cap 42 comprises a base body 50 that can be screwed onto the neck and has an approximately circular opening 52 for the nipple, and a cup-shaped attachment 54 detachably connectable to the basic body 50, in which the nipple is accommodated. The face end 56 of the attachment 54 connectable to the base body 50 has three springs 60, 61 and 62 engaging the opening 52 from behind with detent tabs 64, 65 and 66. The inside of the opening 52 detachably connectable to the detachment 54 has an annular groove 68, which is engaged by the detent tabs 64, 65 and 66 of the springs 60, 61 and 62. The lower region of the inside of the base body 50 has a thread 70, so that the base body 50 can be mated with the thread 72 of the bottle 12. The cylindrical outside of the base body 50 has a plurality of axially aligned grooves 76 and 78, which facilitate the mating of the base body 50.

Figure 3:
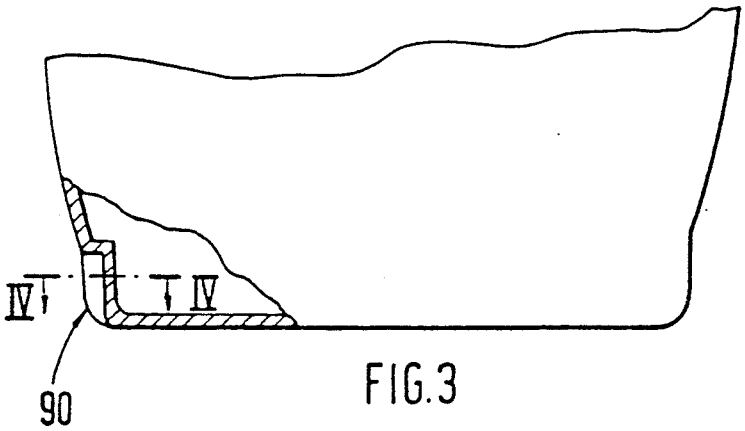
FIG. 3 shows the end toward the bottom of the bottle, shown on an enlarge scale and partly cut away.
Figure 4:
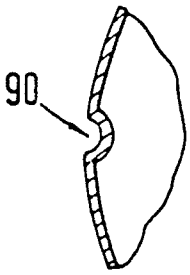
FIG. 4 shows part of the section taken along the line IV—IV of FIG. 3.

A base 80 or part of a base 80 is shown, in FIG. 2 which is detachably connectable to the bottom end of the bottle. The base 80 is a substantially a hollow-cylindrical body that tapers toward its bottom 82. The inside of the base 80 has detent protrusion 85, which is form-fittingly connectable to a detent recess 90 of the bottom of the baby bottle, as shown in FIG. 3.

I claim:

1. In a baby bottle having a neck with a mouth, and a nipple with a horizontal flange, which is supported by an annular cap that is detachably connectable to the neck, the annular cap being shaped as a portion of a hollow cylinder having a radial flange oriented inwardly, the radial flange pressing and sealing the horizontal flange of the nipple against a face end of the mouth, the improvement comprising:

the annular cap (14) connected with a joint (22) to a retaining body (20) having arcuate legs (24, 26), the arcuate legs (24, 26) of the retaining body (20) detachably snapped within a circumferential annular groove (36) about an outer wall of the neck (12), the arcuate legs (24, 26) together extending about more than a 180° segment of a neck circumference of the neck (12); and a first side wall of the annular cap (14) diametrically opposed with respect to the joint (22) having an inwardly directed detent protrusion (32) engageable within a correspondingly positioned detent recess (30) within said outer wall of the neck (12) for detachably connecting the annular cap (14) to the neck (12).

2. In a baby bottle according to claim 1, further comprising: a cup-shaped cover cap (42) having a base body (50) with an opening (52) for receiving the nipple, said cover cap (42) detachably connectable to the neck (12), said cover cap (42) having at least one protrusion (44) extending from an inside surface of said cover cap (42) toward the annular cap (14), when the cover cap (42) is connected to the neck (12) the at least one protrusion (44) being compressed against an upper side of the annular cap (14) which is spaced from a face end (18) of the mouth (10).

3. In a baby bottle according to claim 2, wherein the protrusion (44) is annular and when the cover cap (42) is connected to the neck (12) the annular protrusion (44) is vertically aligned with the neck (12).

4. In a baby bottle according to claim 3, wherein said opening (52) is approximately circular, the nipple is positioned within said opening (52), and said cover cap (42) further comprises a cup-shaped attachment (54), when positioned within said opening (52) a lower portion of said attachment (54) being detachably connectable to said base body (50).

5. In a baby bottle according to claim 4, wherein said lower portion of said attachment (54) that is detachably connectable to said base body (50) has at least one spring (60, 61, 62) each having a detent tab (64, 65, 66) for fixing said attachment (54) within said opening (52).

6. In a baby bottle according to claim 5, wherein the attachment (54) has three said springs (60, 61, 62) circumferentially positioned and circumferentially spaced from each other.

7. In a baby bottle according to claim 6, wherein an inside surface of said base body (50) which defines said opening (52) has an annular groove (68) in which said detent tabs (64, 65, 66) are engageable.

8. In a baby bottle according to claim 2, wherein said opening (52) is approximately circular, the nipple is positioned within said opening (52), and said cover cap (42) further comprises a cup-shaped attachment (54) when positioned within said opening (52) a lower portion of said attachment (54) being detachably connectable to said base body (50).

9. In a baby bottle according to claim 2, wherein a lower portion of an attachment (54) that is detachably connectable to said base body (50) has at least one spring (60, 61, 62) each having a detent tab (64, 65, 66) for fixing said attachment (54) within said opening (52).

10. In a baby bottle according to claim 2, further comprising a cup-shaped attachment (54), when positioned within said opening (52) a lower portion of said attachment (54) being detachably connectable to said base body with three springs (60, 61, 62) circumferentially positioned and circumferentially spaced from each other about said lower portion of said attachment (54).

11. In a baby bottle according to claim 5, wherein an inside surface of said base body (50) which defines said opening (52) has an annular groove (68) in which said detent tabs (64, 65, 66) are engageable.

* * * * *